United States Patent [19]

Kano et al.

[11] Patent Number: 5,046,532

[45] Date of Patent: Sep. 10, 1991

[54] IMPROPER WEFT REMOVING DEVICE FOR AIR JET LOOM

[75] Inventors: Yoshio Kano, Nikawa; Tetsuya Fujioka, Komatsu, both of Japan

[73] Assignee: Kabushiki Kaisha Ishikawa Seisakusho Ltd., Kanazawa, Japan

[21] Appl. No.: 556,527

[22] Filed: Jul. 24, 1990

[30] Foreign Application Priority Data

Aug. 11, 1989 [JP] Japan ..... 1-210831

[51] Int. Cl.[5] ..... D03D 47/34

[52] U.S. Cl. ..... 139/116.2; 139/370.2

[58] Field of Search ..... 139/116.2, 370.2

[56] References Cited

U.S. PATENT DOCUMENTS 4,688,606 8/1987 Tamatani .

4,729,411 3/1988 Ellenberger et al. ..... 139/116.2

4,730,643 3/1988 Tamatani ..... 139/116.2

*Primary Examiner*—Andrew M. Falik

*Attorney, Agent, or Firm*—Burns, Doane, Swecker & Mathis

[57] ABSTRACT

An improper weft removing device for an air jet loom is capable of precisely measuring the length of the improper weft and judging whether the whole of the improper weft has been discharged or a cut piece of the improper weft is left in the open shed of the warps at the time of discharging the improper weft. The device includes a sensor for detecting the passage of the improper weft, a controller for measuring the length of the improper weft according to a signal outputted from the sensor, a nozzle for blowing pressurized air against the end portion of the improper weft thereby controlling the running attitude of the end portion of the improper weft, and a discharge nozzle for delivering the improper weft on an air stream to a discharge dust box, wherein the blowing pressure of the discharge nozzle can be controlled.

2 Claims, 6 Drawing Sheets

IMPROPER WEFT REMOVING DEVICE FOR AIR JET LOOM

BACKGROUND OF THE INVENTION

1. Field of the Invention

The present invention relates to a device for removing an improper weft when a weft is not properly inserted into the open shed of warps in an air jet loom.

2. Description of Related Art

An improper weft removing device extracts an improper weft existing in the open shed of the warps out of the open shed and removes the same. Further, the improper weft removing device preferably has a function of judging whether the whole of the improper weft has been removed or only a part of the improper weft has been removed with the remainder (cut piece) of the improper weft left in the open shed of the warps. This is because, if the improper weft removing device judges that the whole of the improper weft has been removed, the loom can be automatically returned to the regular operation after the removal of the improper weft, and on the other hand, if the device judges that the cut piece of the improper weft is left in the open shed of the warps, the cut piece is required to be removed by any other means.

An improper weft removing device is known in which an improper weft suction box member containing a pair of feed rollers thereinside is provided. According to this, an air suction force (or an air blowing force) acts on the improper weft so as to deviate the improper weft from the regular weft inserting path and bend the same in a U-shaped form. Then the improper weft is cut at a location in the vicinity of the main nozzle by a weft cutter, and the cut improper weft is introduced into the improper weft suction box member. The improper weft introduced into the suction box member is held by the pair of feed rollers and then delivered toward a discharge dust box.

In this improper weft removing device, the rotation member of the feed roller is calculated and the length of the improper weft is calculated based on the obtained rotation number and the outer diameter of the feed roller.

However, in this prior art, since when the improper weft is extracted out of the warps at the time of discharging the improper weft, the friction resistance varies at the beginning and at the end of the improper weft discharge, since the end portion of the improper weft separated from the outer end of the warps is left free, and since the air suction force (or air blowing force) is acting on the improper weft, often the end portion of the improper weft is wound at one time on the feed rollers or the end portion of the improper weft is delivered disadvantageously in the entangled state to the feed rollers. If the improper weft in such a state is delivered toward the discharge dust box, the length of the improper weft cannot be precisely calculated and the device erroneously judges that the cut piece of the improper weft is still left in the open shed of the warps even after extracting the whole of the improper weft therefrom.

SUMMARY OF THE INVENTION

An object of the present invention is to provide an improper weft removing device for an air jet loom capable of precisely measuring the length of the improper weft and precisely judging the complete removal of the improper weft at the time of discharging the improper weft.

Another object of the present invention is to provide an improper weft removing device for an air jet loom capable of smoothly discharging the improper weft.

In order to achieve these objects, an improper weft removing device according to the present invention comprises:

- a downward pressure air nozzle for blowing pressure air in the direction substantially perpendicular to the weft inserting path, said downward pressure air nozzle being disposed between a main nozzle for inserting a weft into the open shed of warps and the outer end of the warps,
- a suction box member for sucking an improper weft existing in the open shed of the warps, said suction box member being disposed below said downward pressure air nozzle,
- a pair of feed rollers for delivering the improper weft toward a discharge dust box, said feed rollers being disposed in said suction box member,
- a discharge nozzle for making the inside of said suction box member at a negative pressure and blowing pressure air so as to deliver the improper weft on an air stream to the discharge dust box, said discharge nozzle being disposed below said pair of feed rollers in said suction box member,
- an improper weft end control means for controlling the running attitude of the end portion of the improper weft by blowing pressure air against the end portion of the improper weft, said weft end control means being disposed upstream of and adjacent to said suction box member,
- a detecting means for detecting the passage of the improper weft, said detecting means being disposed downstream and in the vicinity of said feed rollers,
- an improper weft length measuring means for measuring the length of the improper weft according to a detecting signal outputted from said detecting means, and
- a discharge nozzle pressure control means for controlling the blowing pressure of said discharge nozzle.

Therefore, in comparison with devices of the prior art, the device according to the present invention has such advantages that the end portion of the improper weft can be controlled so as to be always stretched without being entangled, that the improper weft correctly delivered by the feed rollers can be precisely detected by the detecting means, that erroneous judgement of the removal of the improper weft can be prevented, and further that the improper weft can be smoothly discharged.

DETAILED DESCRIPTION OF THE PREFERRED EMBODIMENTS

Figure 1:
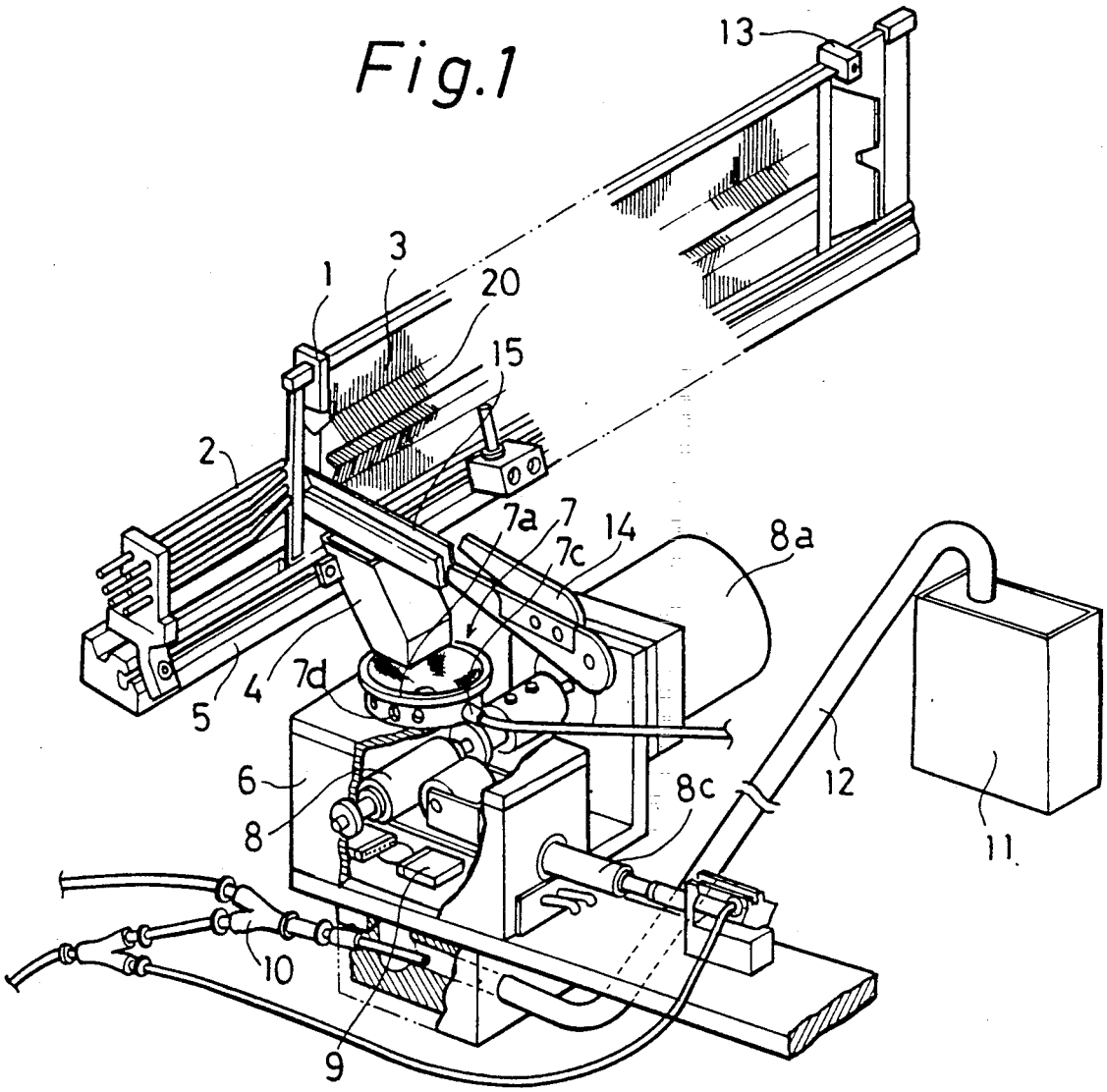
FIG. 1 is a perspective view of an embodiment of an improper weft removing device for an air jet loom according to the present invention.

An embodiment of an improper weft removing device for an air jet loom according to the present invention will be now described with reference to the appended drawings. In FIG. 1, numeral 1 indicates a downward pressure air nozzle which is provided between the head of a main nozzle 2 outer ends of warps 20. The nozzle 1 blows pressure air from the upper portion to the lower portion in the direction perpendicular to the running direction of the weft blown from the main nozzle 2 (namely, the weft guide direction) so as to deviate the weft from the regular weft guide path. The main nozzle 2 inserts the weft into the shed of warps 20. Numeral 4 indicates an air guide attached onto a lay 5, which is constituted by a hollow member and has functions of preventing air blown from the downward pressure air nozzle 1 from being dispersed and of introducing the blown air into a suction box member 6. On the suction box member 6, an improper weft end control means 7 for controlling the running attitude of the end portion of the improper weft by blowing pressure air to the end portion is provided. And inside the suction box member 6, a pair of feed rollers 8 for extracting an improper weft and a detecting means 9 for detecting passage of the improper weft are provided. And the suction box 6 is disposed below the air guide 4.

Figure 2:
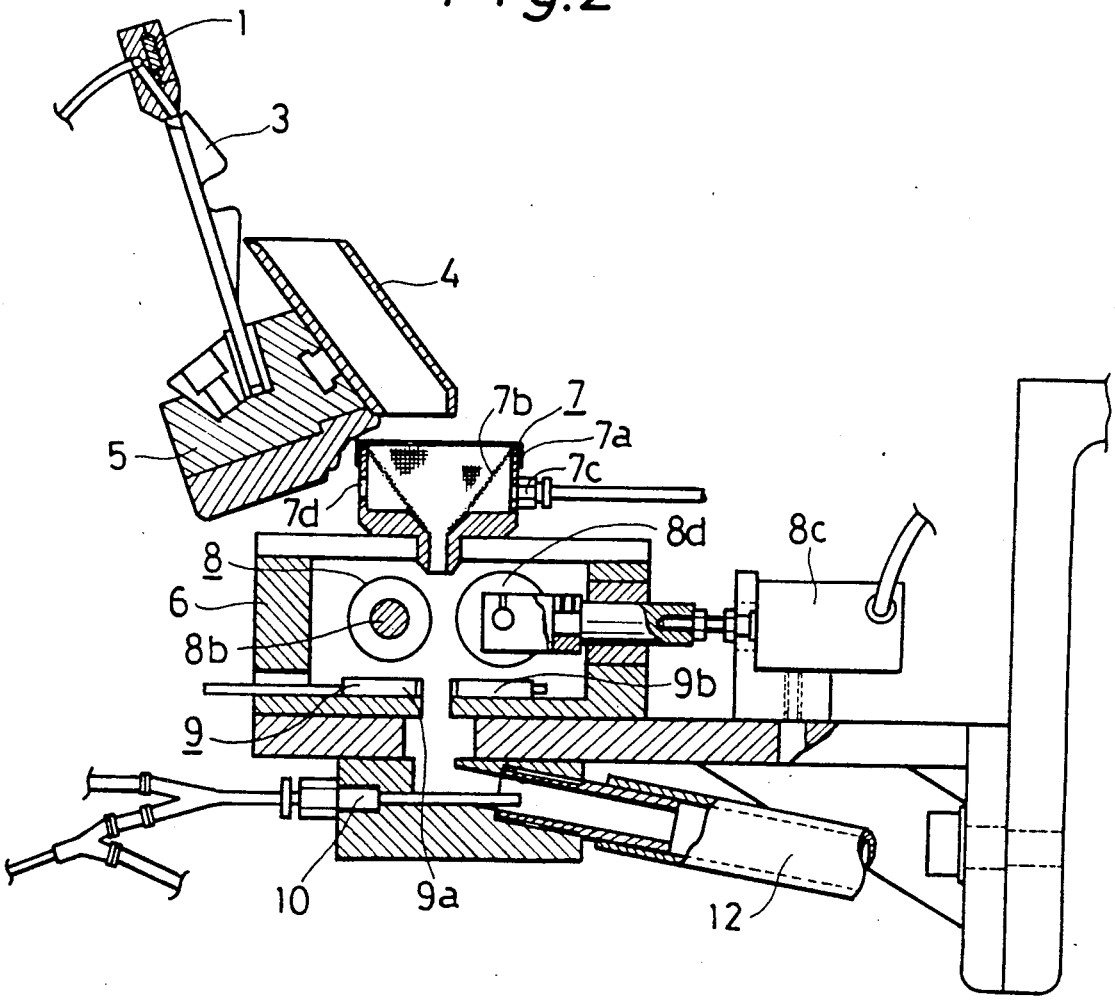
FIG. 2 is a longitudinal sectional side view of the improper weft removing device for an air jet loom.
Figure 3:
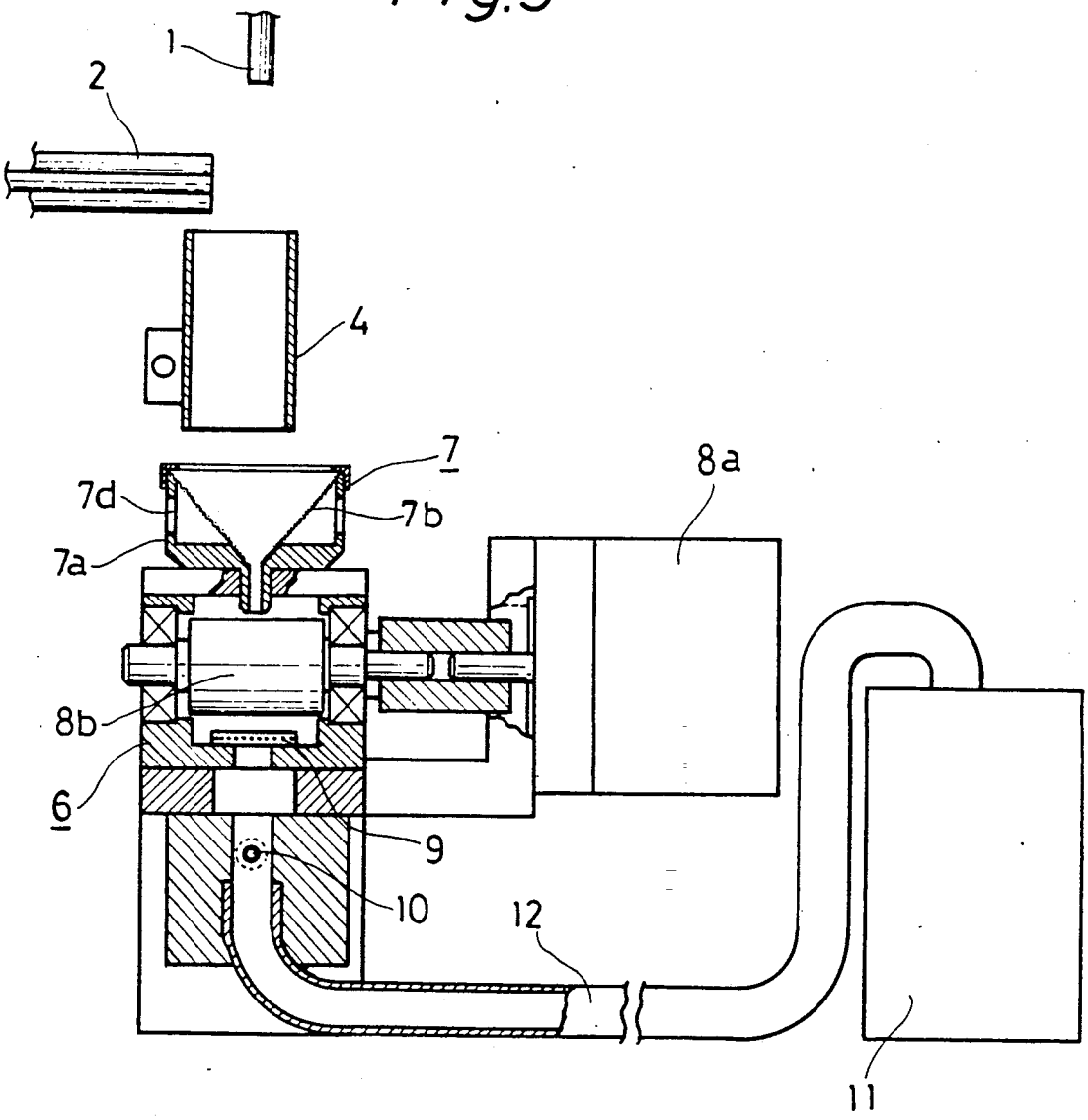
FIG. 3 is a longitudinal sectional front view of the improper weft removing device for an air jet loom.

As shown in FIGS. 2 and 3, the improper weft end control means 7 comprises a funnel-shaped net **7*b* with its upper end opened into a cylindrical member 7*a* and an air jet nozzle 7*c* for blowing pressure air in the horizontal direction against the surface of the net 7*b*, and holes 7*d* for outletting air in the air jet nozzle 7*c* are provided in the outer circumferential surface of the cylindrical member 7*a*. The feed rollers 8 comprise a driving roller 8*b* directly driven by a rotation shaft of a single motor 8*a* and a driven roller 8*d* capable of being in pressure contact with the driving roller 8*b* by means of an air cylinder 8*c*, these rollers 8*b* and 8*d* being disposed below the weft end control means 7**.

The detecting means 9 for detecting the passage of an improper weft comprises a light projector **9*a* and a light receiver 9*b* and constructed to detect the passage of an improper weft by a change of the amount of light. The detecting means 9 is disposed below the feed rollers 8 and is electrically connected to a control means 23 which controls the blowing force of a discharge nozzle 10 according to an input signal from the detecting means 9**.

The discharge nozzle 10 functions as a driving source for introducing the improper weft delivered through the feed rollers 8 to a discharge dust box 11, and the jet opening of the discharge nozzle 10 is disposed under the suction box member 6 and fixed with being oriented to a hollow pipe 12 defining a discharge path of an improper weft.

Numeral 13 indicates a weft detecting device for detecting whether a weft has been properly inserted or not at every weft inserting operation. The weft detecting device 13 is disposed in the vicinity of the outer end of the reed opposite to the weft inserting end thereof.

Further, numeral 14 indicates a weft cutting device and numeral 15 indicates a guide plate for guiding an improper weft at the time of removing the improper weft.

Figure 7:
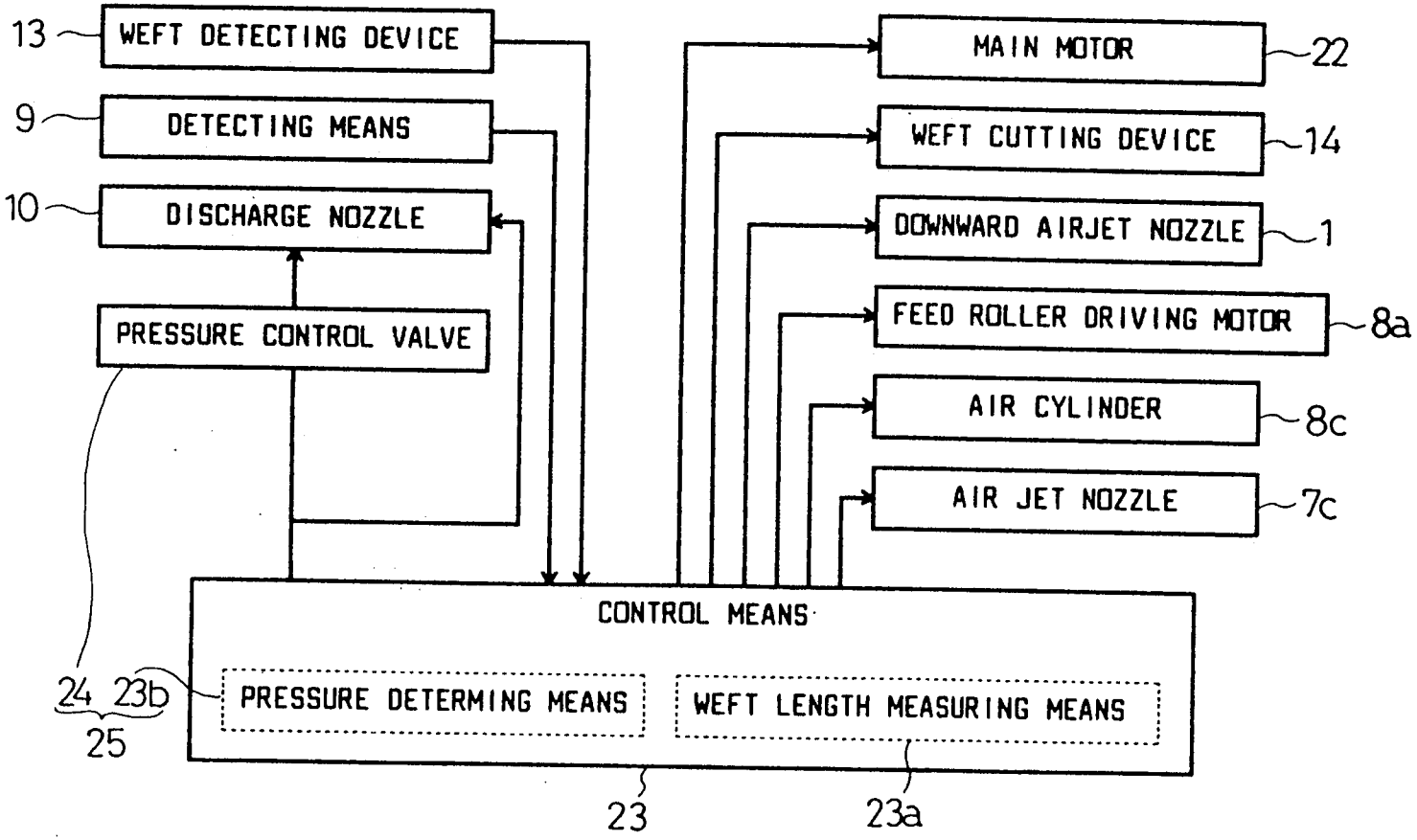
FIG. 7 is a block diagram of a control unit of the improper weft removing device for an air jet loom.

FIG. 7 shows control operation of the improper weft removing device. Detecting signals of the weft detecting device 13 and the detecting means 9 respectively are inputted into the control means 23. The control means 23 is constituted by a microcomputer and outputs control signals to a main motor 22, the weft cutting device 14, the downward air jet nozzle 1, the feed roller driving motor **8*a*, the air cylinder 8*c* and the air jet nozzle 7*c*, thereby controlling each of them. The control means 23 further outputs control signals to the discharge nozzle 10 and a pressure control valve 24 for controlling the air pressure of the discharge nozzle 10, thereby controlling each of them. The control means 23 includes thereinside a pressure determining means for determining the flowing pressure of the discharge nozzle 10 according to a detecting signal outputted from the detecting means 9, and an improper weft length measuring means 23*a* for measuring the length of the weft according to the detection signal outputted from the detecting means 9. The pressure determining means 23*b* and the pressure control valve 24 constitute a pressure control means 25 for controlling the blowing pressure of the discharge nozzle 10**.

One embodiment of an improper weft removing device according to the present invention has the above-mentioned structure, and the operation thereof will be now described in the following. When, during the operation of the loom, a weft inserting error is caused by, for example, entanglement of a weft with the warps for some reason, the weft detecting device 13 detects the error and outputs a signal informing of the error to the control means 23. On receiving the signal, the control means 23 outputs a signal for stopping the operation of the loom to the main motor 22. At the same time with the signal for stopping the operation of the loom, a signal for stopping the operation of the weft cutting device 14, a signal for air blowing of the downward air jet nozzle 1 and a signal for air blowing of the discharge nozzle 10 are outputted from the control means 23. At this time, the loom is rotated by the force of inertia to make substantially one rotation and then is stopped, so that the loom can be prevented from being broken down by a shock caused when it is suddenly stopped while being rotated at a high speed. During this inertia rotation of the loom, the main nozzle 2 pulls out a predetermined length of the weft in continuation with the improper weft from a weft feed source (not shown), and feeds the pulled-out weft as a supplementary weft portion **21*a* elongating the improper weft through the head of the main nozzle 2**.

Figure 4:
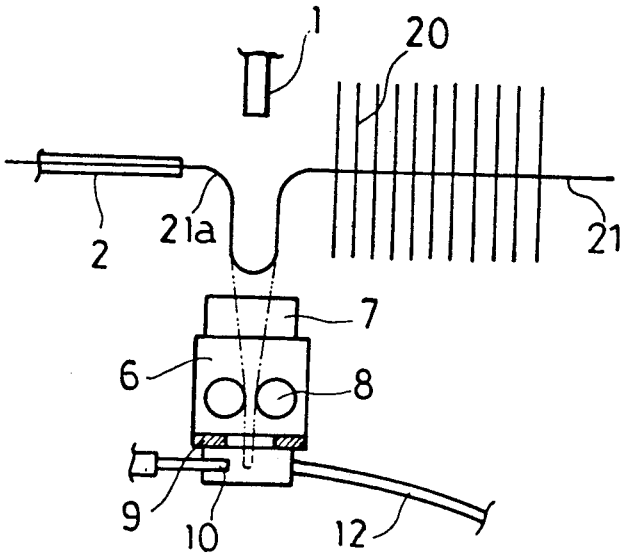
FIGS. 4 to 6 are views for explaining operation of the improper weft removing device for an air jet loom.

The supplementary weft portion **21*a* fed through the head of the main nozzle 2 is blown by the downward air jet nozzle 1 to make a U-shaped form between the head of the main nozzle 2 and the outer end of the warps 20 as shown in FIG. 4. Simultaneously with the blowing of the downward air jet nozzle 1, the discharge nozzle 10 also blows pressure air, and therefore the inside of the suction box member 6 is at a negative pressure by the blowing of the discharge nozzle 10**.

Accordingly, in this condition, an air stream for discharging the improper weft 21 is provided by the downstream air jet nozzle 1 and the discharge nozzle 10. By means of this air stream, the U-shaped supplementary weft portion **21*a* is delivered through the inside of the suction box member 6 toward the discharge dust box 11. At this stage, when the detecting means 9 disposed below the feed rollers 8 detects the passage of the lower end of the U-shaped supplementary weft portion 21*a*, the detecting means 9 outputs a signal to the control means 23. According to this signal, the control means 23** outputs signals for operating the weft cutting device 14 and the feed rollers 8, and at the same time outputs a signal for stopping the blowing operation of the downward air jet nozzle 1, and a signal for changing over the blowing pressure of the discharge nozzle 10 to the pressure control value 24. In other words, firstly the weft cutting device 14 cuts the supplementary weft portion 21*a* of the improper weft 21 at a location in the vicinity of the head of the main nozzle 2. Since the inside of the suction box member 6 is at a negative pressure, the cut end of the supplementary weft portion 21*a* of the improper weft 21 is sucked through the lower part of the suction box member 6 toward the discharge dust box 11.

Figure 5:
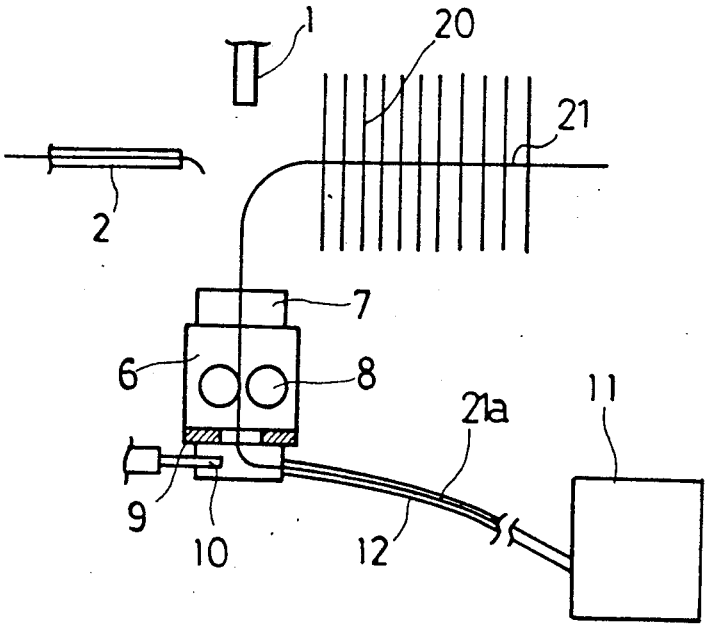

At this stage, as shown in FIG. 5, the cut end of the improper weft 21 reaches the hollow pipe 12 communicated with the discharge dust box 11, while the other end is in the open shed of the warps.

Then, the air cylinder 8*c* is operated to put the driven roller 8*d* into pressure contact with the driving roller 8*b* of the feed rollers, whereby the pair of feed rollers 8 catches the supplementary weft portion 21*a*.

At this stage, the control means 23 receives a signal from the detecting means 9 and outputs, according to the signal, a signal for changing over the blowing pressure to the pressure control valve 24, so that the blowing pressure of the discharge nozzle 10 is changed over to a lower pressure. If the blowing pressure of the discharge nozzle 10 at the time of discharging the improper weft 21 is too high, the end portion of the improper weft 21 is entangled at one time in the suction box member 6 and sucked in this state. The abovementioned blowing pressure lowering operation is effected in order to prevent this. Further, according to the kind and fineness of the weft, the weft itself is sometimes cut by the suction force of the suction box member 6 and the air blowing force of the discharge nozzle 10 in the hollow pipe 12 in the weft discharge path. The abovementioned blowing pressure lowering operation is effected also in order to prevent this. Furthermore, by this blowing pressure lowering operation, the weft delivering force is most adequately controlled through the weft discharge path, thereby saving the need of the energy.

The reason why the blowing pressure of the discharge nozzle 10 is set somewhat high at first is that such a high blowing pressure is necessary for the discharge nozzle 10 to deviate the supplementary weft portion 21*a* of the improper weft 21 from the regular weft inserting path, put the same into a U-shaped form and deliver the same toward the discharge dust box 11.

Then, air is blown by the air jet nozzle 7*c* of the weft end control means 7. The air stream blown by the air jet nozzle 7*c* is gradually dispersed from the open end of the nozzle 7*c*. At this time, most part of the air stream passes the funnel-shaped net 7*b* and goes away through the holes 7*d* in the outer circumferential surface of the cylindrical member 7*a* to the outside. On the other hand, a part of the air stream is upwardly discharge along the inclined surface of the net 7*b*.

Figure 6:
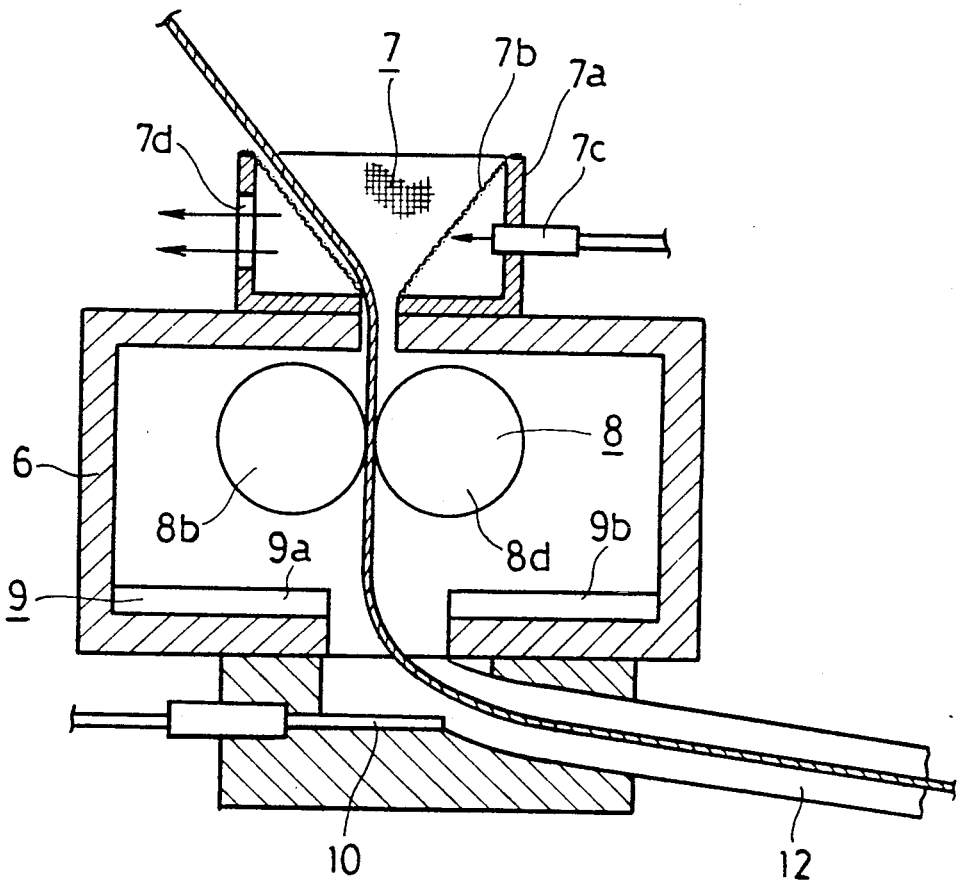

Next, by operating the motor 8*a*, the feed rollers 8 are driven. By the rotation of the feed rollers 8, the improper weft 21 is extracted from the open shed of the warps and at the same time is successively delivered toward the discharge dust box 11. When the rear end portion of the improper weft is extracted from the open shed of the warps and it is in the free state owing to the absence of friction resistance against the warps 20, the rear end portion of the improper weft 21 is so controlled as to be in line with the net 7*b* as shown in FIG. 6 by the air jet stream blown from the air jet nozzle 7*c*. Accordingly, the rear end portion of the improper weft 21 is prevented from being entangled to form a knot. And when the detecting device 9 detects the passage of the end of the improper weft, the rotation of the feed rollers 8 is stopped. Then, the operation of the air cylinder 8*c* is stopped, so that the driven roller 8*d* returns to the waiting position. At this stage, the detecting means 9 detects the passage of the improper weft, and the weft length measuring means 23*a* compares the time needed for the passage of the improper weft with a predetermined reference time, and judges that the improper weft has been completely removed when the compared value is within a predetermined range.

Although the present invention has been fully described by way of an example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An improper weft removing device for an air jet loom comprising:

a downward pressure air nozzle for blowing pressure air in a direction substantially perpendicular to a weft inserting path, said downward pressure air nozzle being disposed between a main nozzle for inserting a weft into an open shed of warps and an outer end of the warps, a suction box member for sucking an improper weft existing in the open shed of the warps, said suction box member being disposed below said downward pressure air nozzle, a pair of feed rollers for delivering the improper weft toward a discharge dust box, said feed rollers being disposed in said suction box member, a discharge nozzle for making the inside of said suction box member at a negative pressure and for blowing pressure air so as to deliver the improper weft on an air stream to the discharge dust box, said discharge nozzle being disposed below said pair of feed rollers in said suction box member, an improper weft end control means for controlling the running attitude of the end portion of the improper weft by blowing pressure air against the end portion of the improper weft, said improper weft end control means being disposed upstream of and adjacent to said suction box member, detecting means for detecting the passage of the improper weft, said detecting means being disposed downstream and in the vicinity of said feed rollers, improper weft length measuring means for measuring the length of the improper weft according to a detection signal outputted from said detecting means, and discharge nozzle pressure control means for controlling the blowing pressure of said discharge nozzle.

2. An improper weft removing device for an air jet loom as claimed in claim 1, wherein said improper weft end control means comprises a cylindrical member disposed in a vertical direction, a funnel-shaped net, the outer circumference of which is supported by said cylindrical member, an air jet nozzle for blowing pressure air substantially in a horizontal direction against the surface of the funnel-shaped net, and air outlet holes provided in the cylindrical member.

* * * * *